United States Patent [19]

Van Ginkel et al.

[11] 4,255,831

[45] Mar. 17, 1981

[54] MODELLING APPARATUS FOR POULTRY

[75] Inventors: Mannes Van Ginkel; Jan Plug, both of Barneveld, Netherlands

[73] Assignee: Moba Holding Barneveld B.V., Barneveld, Netherlands

[21] Appl. No.: 964,271

[22] Filed: Nov. 28, 1978

[30] Foreign Application Priority Data

Dec. 9, 1977 [NL] Netherlands ..... 7713638

[51] Int. Cl.[3] ..... A22C 21/00

[52] U.S. Cl. ..... 17/11; 53/529

[58] Field of Search ..... 17/11, 49; 53/523, 529

[56] References Cited

U.S. PATENT DOCUMENTS

| | | | |
|---|---|---|---|
| 3,817,167 | 6/1974 | Mosterd | 17/11 X |
| 3,864,787 | 2/1975 | Mosterd | 17/11 |
| 4,121,321 | 10/1978 | Mosterd | 17/11 |

*Primary Examiner*—Willie G. Abercrombie

[57] ABSTRACT

A device for modelling poultry provided with pivotably interconnected shell members and flaps, the latter being pivotably mounted, for catching the wings, from an open or spread-out position towards a position in which their end edges nearly engage each other, so that the wings are guided and laid against the body of the poultry before the shell members of the modelling apparatus close.

8 Claims, 7 Drawing Figures

MODELLING APPARATUS FOR POULTRY

The invention relates to a device for modelling poultry, provided with a modelling tube consisting of a first shell member and further shell members pivotably connected with the end edges of the first shell member, driving means for pivoting the further shell members from a first position, in which the three shell members form an open shell towards the second position in which they form a tube, and enclosure means which are movable from a first position, in which they leave free the open side of the free shell members forming the open shell into a second position, in which they close the shell.

Such a device as described thus far is known from U.S Pat. No. 4,121,321.

Though this device usually operates satisfactory it has been shown that improvement is possible with respect to seizing and taking along the wings in all cases in order to lay them in the desired shape against the body of the poultry. Moreover the known device is relatively complicated.

A goal of the invention is to provide a device of the type described which is in principle simpler and with greater reliability provides good modelling notwithstanding the deviating shapes of the wings or the presence of damaged wings.

The above goals are achieved according to the invention in that the closure means consist of flaps that pivot about edges, which are located near the further shell members when they are in their first position, driving means for moving the flaps from a first spread-out position in which their end edges are away from the pivot axes spaced from each other into a second position, in which the end edges are near each other.

An especially favourable embodiment of the invention is achieved according to a further elaboration of the invention if the flaps have the shape of a circular arc with a radius, which equals the distance between the end edges of the further shell members and the axis of the pivot connections. Therewith it is possible to have the further shell members engagingly move along the flaps, after the flaps have been moved into their second position, by reason of which security is obtained that no parts of the poultry or the wings remain outside the further shell members.

A simple control device for the device according to the invention is characterized by a control slide, provided with first recesses in which first follower members can be inserted, which are connected with an activating arm of the flaps, a guide for this activating member being associated with the recess. Herewith an easy control possibility of the flaps is obtained with which in the same manner also the further shell members can be controlled.

According to an embodiment of the invention the device is mounted to a frame movable along a fixed track. As is known, this provides the advantage that the input location of the poultry and the output location of the modelled poultry are mutually spaced, which enhances an efficacious use of the device. Moreover it is possible to obtain an accurate and reliable control of the device by mounting control guides along the track cooperating with follower members of parts of the device.

According to a further elaboration of the invention this idea is made useful by providing that along the path of the frame to which the device has been mounted, a control guide is present and that the flaps are provided with follower members which can cooperate with the control guide. Herewith the flaps can be brought to their end position in a very reliable way.

When using the invention it is important that the wings are seized correctly first by the flaps and afterwards by the further shell members. It has been shown, that the operation of the invention can be enhanced by providing a suspension hook for a poultry and means for imparting a downward movement to the hook, combined with a horizontal displacement thereof in the direction from the open side of the open shell towards the first shell member. This downwardly directed somewhat swinging movement of the poultry has proven to be favourable and reliable for bringing wings having deviating shapes within the working region of the flaps.

The invention is described below with reference to the accompanying drawing, in which.

Figure 3:
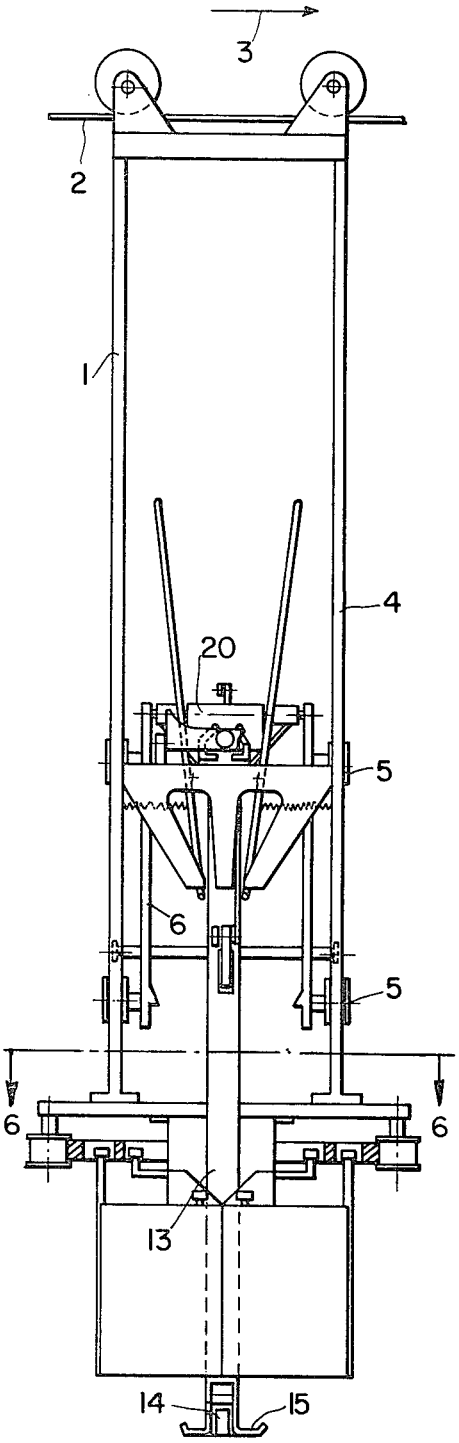
Figure 1:
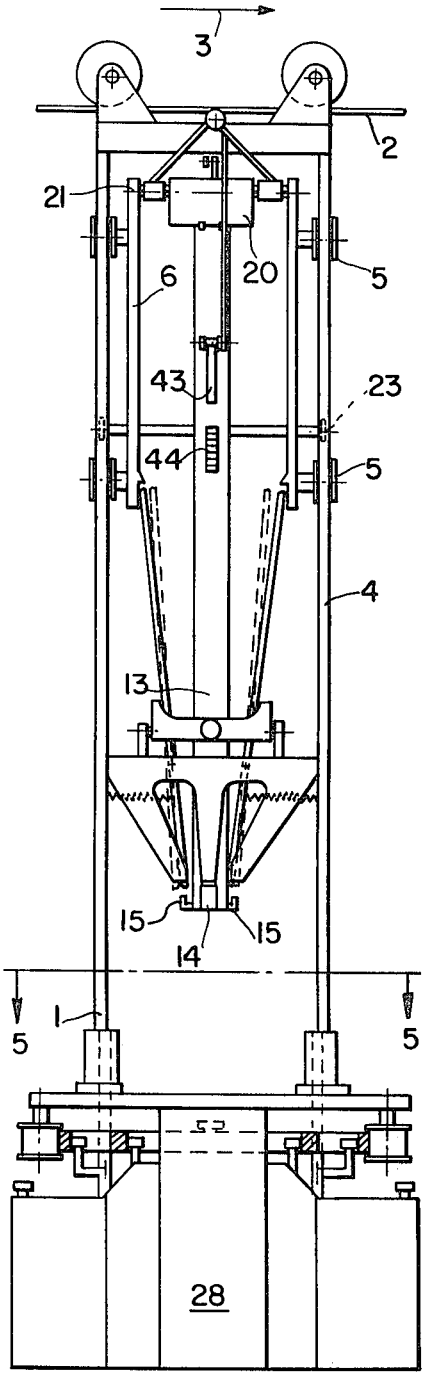
FIG. 1 shows a front elevational view of the invention, partly schematical.
Figure 2:
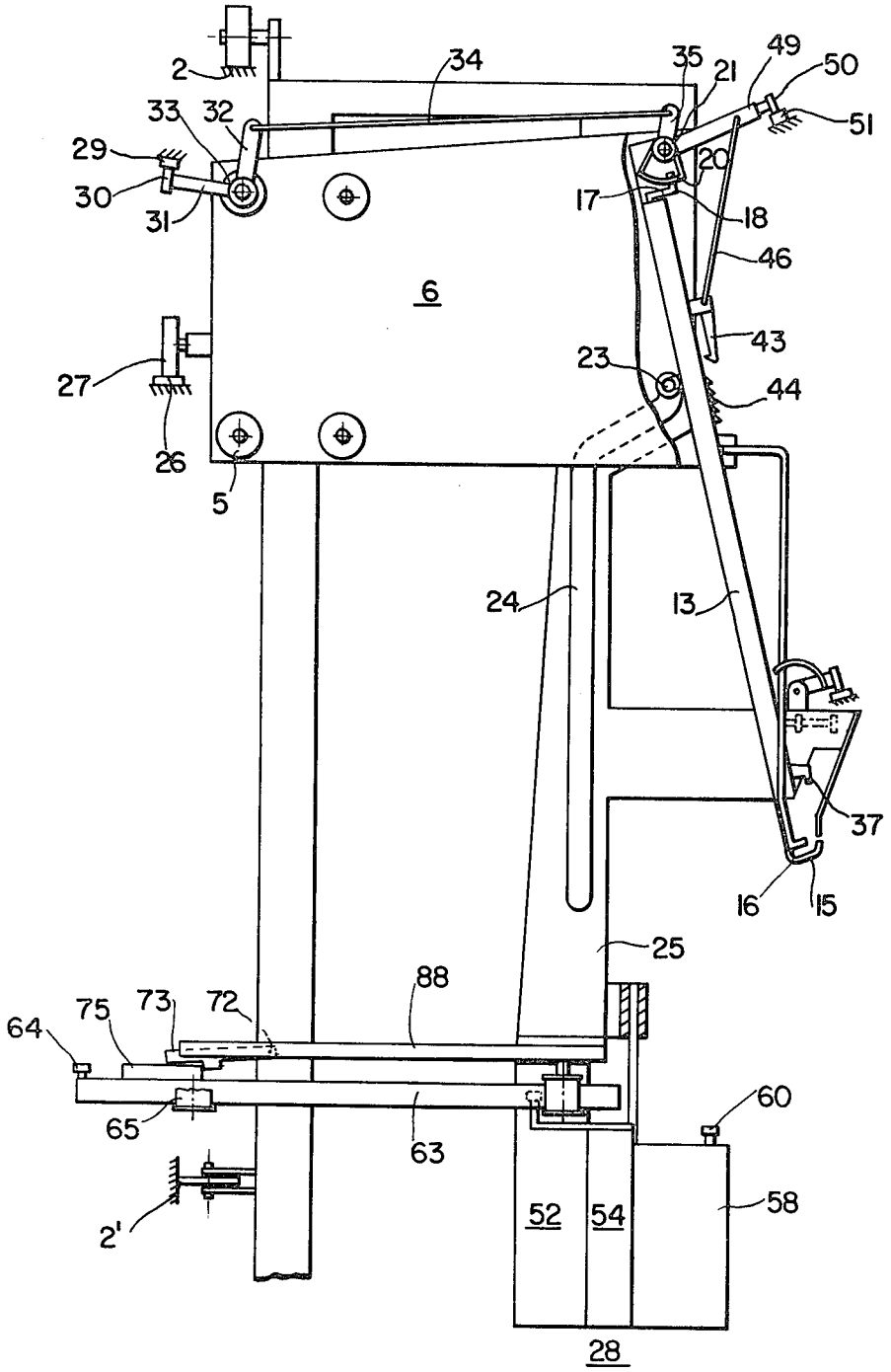
FIG. 2 shows a side view of the device of FIG. 1.
Figure 4:
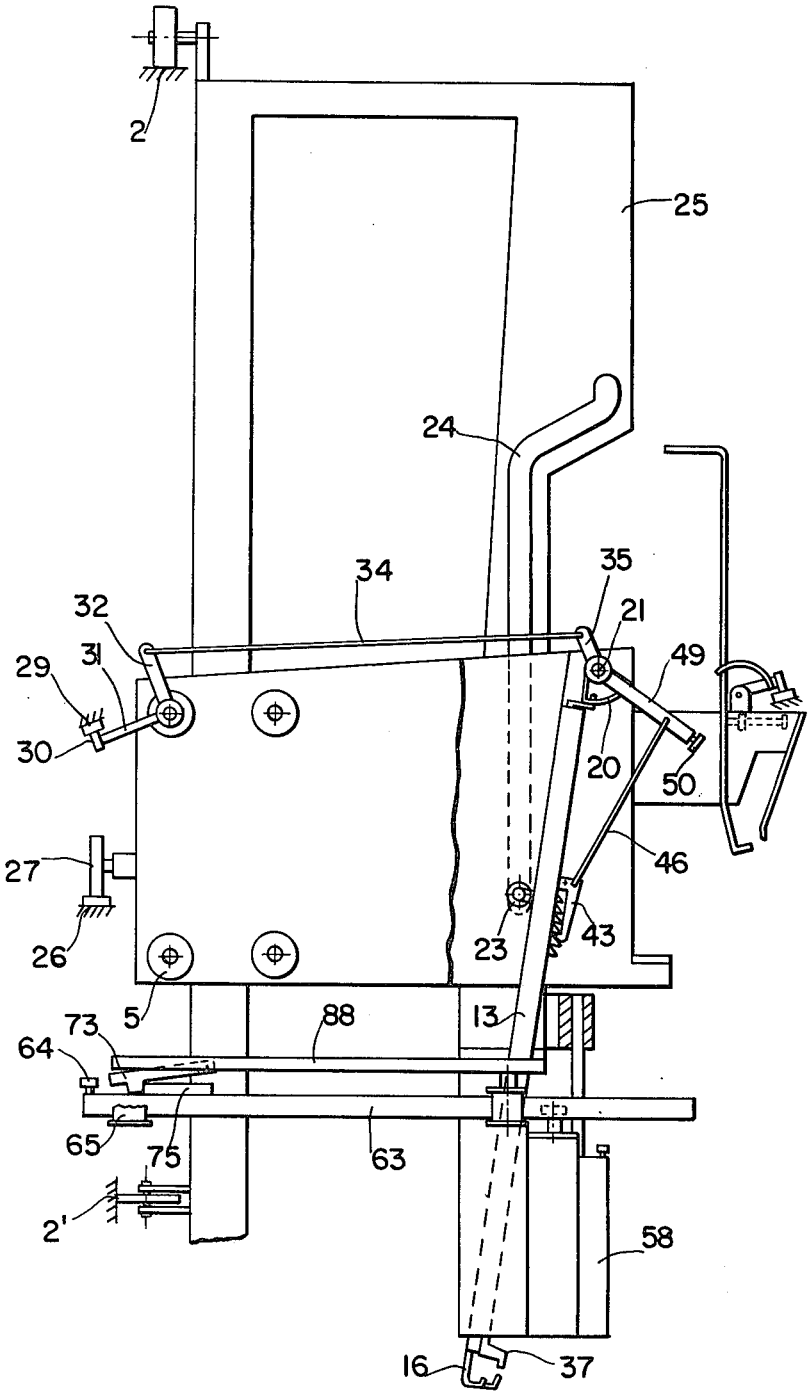
Figure 5:
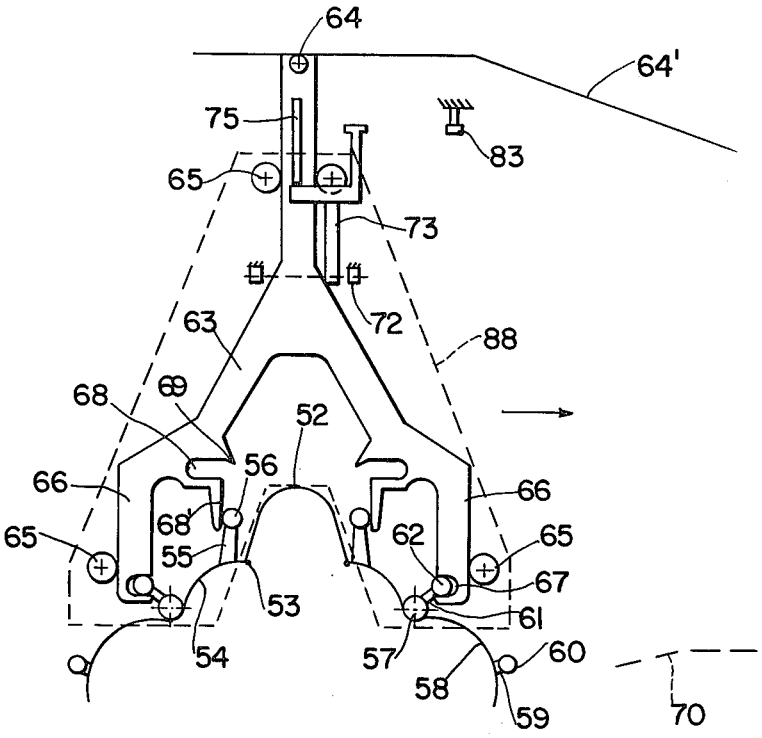
Figure 6:
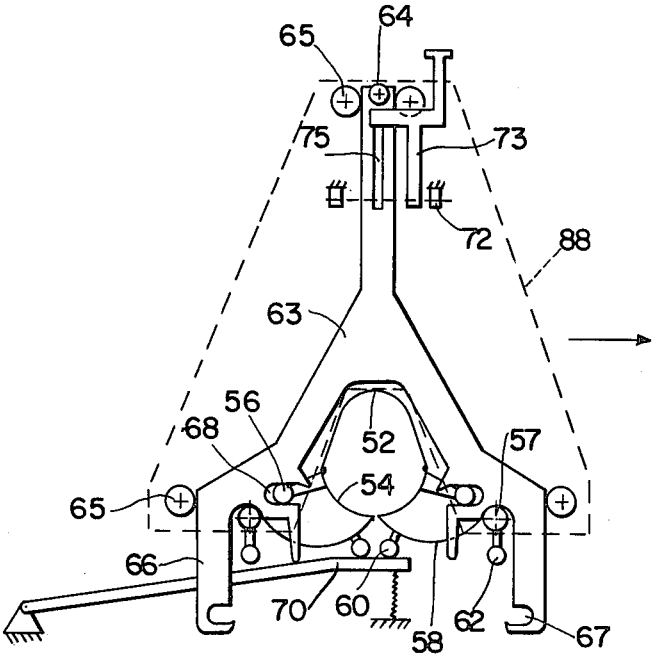
Figure 7:
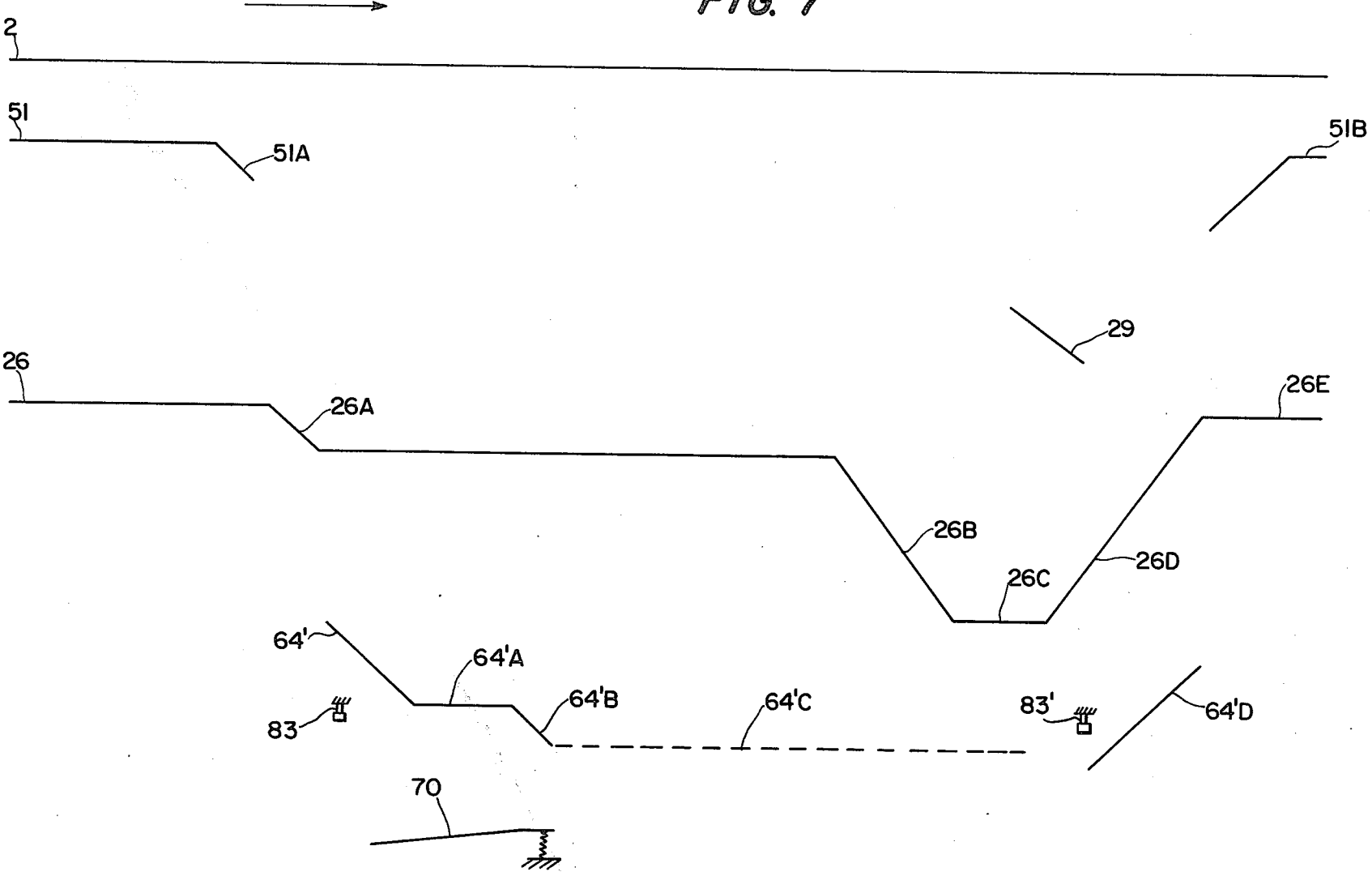

FIG. 3 corresponds to FIG. 1, but shows a further position of the device;

FIG. 4 corresponds to FIG. 2 with the device in the position shown in FIG. 3;

FIG. 5 shows a plan view of portion of the device taken along line 5—5 of FIG. 1;

FIG. 6 shows a plan view similar to FIG. 5 but showing the device in position taken along line 6—6 of FIG. 3; and FIG. 7 shows a chart of the several control guides.

In the drawing 1 indicates a frame which, by means of wheels can be moved along a fixed track 2 and 2' in the direction of the arrow 3. The frame 1 is provided with vertical rails 4, along which a sub frame 6 can be moved vertically by means of wheels 5.

The sub frame 6 supports a bar 13 having at its lower end a fixed finger 14 and two pivotable fingers 15, for receiving the knee-joints of a poultry. The bar 13 is pivotable about a shaft 21, which has been fixedly mounted in the sub frame 6 and is provided with a follower roll 23 running in a slot 24 formed in a sheet 25 fixedly connected to the frame 1.

The sub frame 6 bears by means of a supporting wheel 27 on a control guide 26, whereas to control opening and closing of the fingers 14, 15 a control guide 29 is present. By means of a follower wheel 30 the controls guide 29 position of a hooked arm 31, 32 which by means of a link 34 controls an arm 35 which is connected to a plate segment 20 in which control slots (not shown) have been formed in which slide pins 18 are inserted. Turning of arms 17 turns rod 16 (most of which is within bar 13 and hence not visible) about their pivot axes. Rod 16 are connected at their lower ends to the pivotable fingers 15, so that if the control guide 29 inclines downwardly the plate segment 20 is pivoted counter-clockwise and the fingers 15 are pivoted outwardly towards their opened position.

A clamping member 37 is connected to a rod mounted within the bar 13. At the upper end of bar 13 a ratchet 43 has been connected, which by means of rod 46 is connected to a member 49 which is pivotable about the shaft 21 and at its end is provided with a follower roll 50, which runs on a control guide 51. When the control guide 51 ends or declines downwardly the clamping member 37 can move downwardly until it engages the knee-joints. after which the ratchet 43 engages the teeth of the rack 44 which is fixedly connected to the bar 13. This means that the clamping member 37 is locked with respect to the fingers 14, 15 in a position which is dependent on the dimensions of the knee-joints.

The device described thus far is applicable to any device for handling poultry in which the poultry; is suspended by each of its knee-joints. The type of modelling apparatus to which the invention relates is schematically indicated at 28 and in plan view in FIGS. 5 and 6.

In FIG. 5 reference 52 indicates a first shell member at the ends of which by means of hinges 53 the further shell members 54 are mounted. The shell member 52 and the hinges 53 have a fixed position with respect to the frame 1 (FIGS. 1–4 incl.). The shell member 52 has approximately a parabolic cross-section whereas the shell members 54 are circle cylindrical segments. The shell members 54 support arms 55, each of which are provided with a follower roll 56.

Further flaps 58 are pivotably mounted to shafts 57 fixed connected to frame 1, which flaps in connection with their operation as explained below will be called wing catch flaps and which support arms 59, provided with follower rolls 60. Further arms 61 are fixedly conneted to the wing catch flaps 58, which arms at their ends support follower rolls 62. The wing catch flaps 58 have a cross-section corresponding to part of a circle. A control slide 63 is movable with respect to frame 1 in a horizontal direction and can be placed under control of a follower roll 64. The control slide 63 is guided by guide wheels 65 and has two legs 66 (FIGS. 5 and 6) of which the outer surfaces cooperate with the guide wheels 65 whereas at the inner side of the legs 66 recesses 67 are present, in which, in the starting position of FIG. 5, the follower rolls 62 are located. The inner sides of the legs 66 in their regions immediately to the rear the recesses 67 form guide surfaces for the follower rolls 62.

The follower rolls 56 engage in the position shown in FIG. 5 the guide surfaces 68' which at their rear ends are delimited by recesses 68.

The closing movement of the wing catch flaps 58 is initiated when the slide moves forwardly from the position of FIG. 5 towards the position of FIG. 6. Then the arms 61 are pivoted under control of the follower rolls 62 and swing the wing catch flap 58 inwardly. This continues until the follower rolls 62 leave the recesses 67 and remain in engagement with the inner side of the legs 66, by reason of which pivoting back of the wing catch flaps 58 is prevented. The wing catch flaps 58 now engage the poultry by reason of which they cannot completely swing inwardly.

The movement of the slide 63 occurs because the follower roll 64 engages the control guide 64' by reason of which the slide moves forwardly. The position is thereby reached in which the wing catch flaps 58 are almost closed. Now the follower rolls 60 engage a spring biased control guide 70 and are further closed.

In the meantime the protrucsions 69 above the recesses 68 engage the follower rolls 56 by reason of which these are forced into the recesses 68, causing the further shell members 54 to pivot. The end edges of these shell members thereby very near to or in engagement with the hollow inner side of the wing catch flaps 58, so that no parts of the poultry can be left out of the tube formed by members 52 and 54.

Because the control guide 70 is elastically mounted, the shell members 54 can, if necessary, pivot the wing catch flaps 58 partially outwardly.

The poultry is already at the level of the modelling apparatus in the region of the shell member 52 before the closing movements of the wing catch flaps 58 and the shell member 54 begin. After this closing movement the poulty is pushed downwardly through the modelling apparatus by a downward movement of the bar 13 with the fingers 14, 15 when the sub frame 6 moves further downwardly.

The operation of the device is that when the poultry has wings which are irregular or which hang far out, the wings are moved inwardly by the wing catch flaps 58 until these flaps are practically at their inward end position. After this the shell members 54 move from their position of FIG. 5 towards that of FIG. 6 and take the wings along with them. The result is that the wings, whether or not they initially depended in an irregular way, are laid well against the body of the poultry to be modelled.

Further in FIGS. 2, 4, 5 and 6 a pawl has been shown that can pivot about pivot points 72 which are fixedly connected to the frame 1 by means of a sheet 88. This pawl 73 in the position of FIGS. 2 and 5 engages the front side of a rib 75 of the slide 63 and is lifted by an abutment 83 (see FIG. 7) that is fixedly mounted along the track 2, which lifting happens at the moment that the guide 64' via the control roll 64 is about to displace the slide. After this the pawl 73 bears on the rib 75 until the position is reached at which the slide is completely moved forward and then pawl 73 falls behind the rib 75 by reason of which it locks the shell members in the position of FIG. 6 (see also FIG. 4).

After the clamping member 37 has been moved downwardly the poultry is moved by the hook formed by fingers 14, 15 firstly towards the shell member 52 and thereafter the control of the wing catch flaps 58 and the further shell members 54 are activated. When these have been closed the bar 13 together with the fingers 14, 15 move further downwards under the influence of the shape of the guide 26 and bring the poultry to a packing device (not shown).

After the pawl 73 has been lifted by a suitable abutment 83' (FIG. 7) the slide 64 can again be moved from the position of FIG. 6 towards that of FIG. 5 by a suitable shape of the control guide 64'.

In the drawing the control guide 70 is shown as mounted by means of springs. The reason for this is that the thickness of a poultry is not always the same, so that a poultry that is too thick cannot damage the modelling apparatus 28 or cause jamming of the device.

FIG. 7 shows the control guides. Herein the guides 29, 51 and 26 are located in a vertical plane, whereas guides 64' and 70 are located in a horizontal plane. The abutments 83 and 83' are active in the vertical direction to lift the pawl 73.

When the frame 1 with the sub frame 6 and the modelling apparatus 28 moves in FIG. 7 from left to the right firstly the poultry is placed with its knee-joints between the fingers 14, 15. After this guide 51 declined at 51A and ends, by reason of which, via 50, 49 and 46 the clamping member 37 falls onto the knee-joint and is upwardly locked because of the engagement of the ratchet 43 with the teeth of the rack 44.

Following this the sub frame 6 moves downwardly by reason of the downwardly declining part 26A of guide 26. After this the pawl 73 is lifted by abutment 83 and by cooperation between the follower roll 64 and the guide 64' the slide 63 is shifted from the position of FIG. 5 to that of FIG. 6. The elastically mounted guide 70 creates via the follower rolls 60a reaction force when the follower roll 64, cooperating with guide part 64'B shifts the slide still further towards the position of FIG. 5.

At the end of the guide part 64'B the pawl 73 falls behind the back side of the rib 75 so that the modelling apparatus is in the locked position which is further indicated by an interrupted line 64'C.

When the follower roll 27 engages the part 26B of guide 26 the sub frame moves downwardly and by means of the bar 13 and the fingers 14, 15 the poultry is pushed downwardly through the modelling tube which at that moment is closed, towards a packing device mounting below the tube (not shown).

In the horizontal part 26C of guide 26 the control guide 29 cooperates with follow roll 30 for pivoting the fingers 15 away from the finger 14 by means of 31, 32, 33, 34, 35, 20, 18, 17 and 16 by reason of which the poultry can be taken out of the lower side of the modelling apparatus. Following this the sub frame 6 is moved upwardly again under influence of the guide part 26D of guide 26.

Therewith abutment 83' again lifts the pawl 73 so that the slide, under influence of the part 64'D of guide 64', can move rearwardly towards the position of FIG. 5 to be locked in this position because pawl 73 cooperatives again with rib 75. Finally, when the sub frame 6 is again at its initial level (part 26E of guide 26) the guide part 51B of guide 51 becomes active and swings ratchet 43 counter-clockwise by means of 50, 49 and 46, after which the ratchet 43 and the clamping member 37 move upwardly towards their initial position.

What I claim is:

1. A device for modelling poultry, comprising a modelling tube having a first shell member having end edges and a pair of further shell members having first ends pivotably connected with the said end edges of the first shell member, driving means for pivoting the further shell members from a first position, in which the first and further shell members form an open shell towards the second position in which they form a tube, and enclosure means which are movable from a first position, in which they leave free the open side of the shell members forming the open shell into a second position, in which they form a closed shell, said enclosure means comprising flaps which pivot about shafts which are located near second end edges of the further shell members farthest from the first shell member when the further shell members are in their first position, driving means for moving the flaps from a spreadout position in which their free end edges are spaced from each other towards a second position in which these end edges are near to each other.

2. A device according to claim 1, in which the said flaps have a cross-sectional shape of an arc of a circle with a radius which equals the distance between the said second end edges of the further shell members and the axis of their pivot shafts.

3. A device according to claim 1, each of said flaps having an activating arm and a follower member thereon, and said driving means for moving the flaps comprising a horizontally movable control slide having recesses for receiving such follower members and pivoting the flaps upon movement of the control slide, and a guide surface adjacent said recesses for guiding the flaps after they have been at least partially pivoted about their axes.

4. A device according to claim 3, said further shell members having follower members thereon, and said driving means for pivoting the further shell members also comprising said control slide, wherein the control slide has further guide surfaces and adjacent thereto further recesses for cooperating with the shell member follower members.

5. A device according to claim 4, in which the control slide is movable from a first position towards a second position wherein in the first position the flap follower members are located within their respective recesses and the further follower members engages the further guides, so that upon movement of the slide from a first rearward position towards a second position firstly the flaps are pivoted and after this the further shell members are closed.

6. A device according to claim 1, including a frame on which the device is mounted, said frame being movable along a fixed track, said flaps having follower members fixed thereto, a resilient control guide positioned along the track, and said flap follower members positioned to cooperate with the control guide to resiliently move the flaps toward their said second position.

7. A device according to claim 1, including a suspension hook for holding a poultry and means for imparting to this hook a downwardly movement combined with a horizontal displacement in the direction from the open side of the open shell towards the first shell member.

8. A device according to claim 5, including a locking means for locking the control slide in both of said first and second positions.

* * * * *